US010737496B2

(12) United States Patent
Ito et al.

(10) Patent No.: US 10,737,496 B2
(45) Date of Patent: Aug. 11, 2020

(54) LIQUID EJECTING APPARATUS AND MAINTENANCE METHOD THEREOF

(71) Applicant: SEIKO EPSON CORPORATION, Tokyo (JP)

(72) Inventors: Hiroyuki Ito, Matsumoto (JP); Hitotoshi Kimura, Matsumoto (JP); Atsushi Ono, Matsumoto (JP)

(73) Assignee: Seiko Epson Corporation, Tokyo (JP)

( * ) Notice: Subject to any disclaimer, the term of this patent is extended or adjusted under 35 U.S.C. 154(b) by 0 days.

(21) Appl. No.: 16/252,444

(22) Filed: Jan. 18, 2019

(65) Prior Publication Data

US 2019/0224975 A1 Jul. 25, 2019

(30) Foreign Application Priority Data

Jan. 23, 2018 (JP) ..... 2018-008601
Jan. 23, 2018 (JP) ..... 2018-008602

(51) Int. Cl.
*B41J 2/165* (2006.01)

(52) U.S. Cl.
CPC ..... *B41J 2/16547* (2013.01); *B41J 2/16508* (2013.01); *B41J 2/16517* (2013.01); *B41J 2/16523* (2013.01); *B41J 2/16538* (2013.01); *B41J 2/16579* (2013.01); *B41J 2002/16502* (2013.01)

(58) Field of Classification Search
USPC ..... 347/23
See application file for complete search history.

(56) References Cited

U.S. PATENT DOCUMENTS 5,455,608 A 10/1995 Stewart et al.
7,364,254 B2 * 4/2008 Yamazaki ..... B41J 2/125 347/19
2003/0117455 A1 6/2003 Bruch et al.
2003/0142161 A1 7/2003 Mura et al.
2004/0085391 A1 * 5/2004 Kanaya ..... B41J 2/16508 347/35
2008/0218549 A1 9/2008 Iriguchi
2014/0253632 A1 9/2014 Matsumoto
2015/0029249 A1 1/2015 Seino et al.
2016/0243832 A1 8/2016 Kobayashi
2017/0264754 A1 9/2017 Mano

FOREIGN PATENT DOCUMENTS

JP H7-47684 A 2/1995
JP 2000-168105 A 6/2000
JP 2000-238274 A 9/2000
(Continued)

*Primary Examiner* — Lam S Nguyen
(74) *Attorney, Agent, or Firm* — Workman Nydegger

(57) ABSTRACT

Disclosed is a liquid ejecting apparatus including a liquid ejecting portion provided with a liquid ejecting head and configured to move the liquid ejecting head in a head moving area in a scanning direction, and the head moving area includes a landing area in which the liquid is ejected from the nozzle and landed onto a medium that is placed in a placement portion, an receiving area in which a liquid receiving portion is provided, and a maintenance area in which a maintenance cap is provided, and the receiving area is disposed at a position farther from the landing area than from the maintenance area in the scanning direction.

11 Claims, 11 Drawing Sheets

(56) References Cited

FOREIGN PATENT DOCUMENTS

| | | | |
|---|---|---|---|
| JP | 2001-315352 | A | 11/2001 |
| JP | 2003-320690 | A | 11/2003 |
| JP | 2006-142702 | A | 6/2006 |
| JP | 2008-221482 | A | 9/2008 |
| JP | 2008-247019 | A | 10/2008 |
| JP | 2009-119652 | A | 6/2009 |
| JP | 2009-178892 | A | 8/2009 |
| JP | H11-179884 | A | 8/2009 |
| JP | 2009-234206 | A | 10/2009 |
| JP | 2011-42047 | A | 3/2011 |
| JP | 2013-116635 | A | 6/2013 |
| JP | 2003-341107 | A | 12/2013 |
| JP | 2014-162052 | A | 9/2014 |
| JP | 2014-172239 | A | 9/2014 |
| JP | 2015-24566 | A | 2/2015 |
| JP | 2016-153197 | A | 8/2016 |
| JP | 2016-215410 | A | 12/2016 |
| JP | 2017-159527 | A | 9/2017 |

* cited by examiner

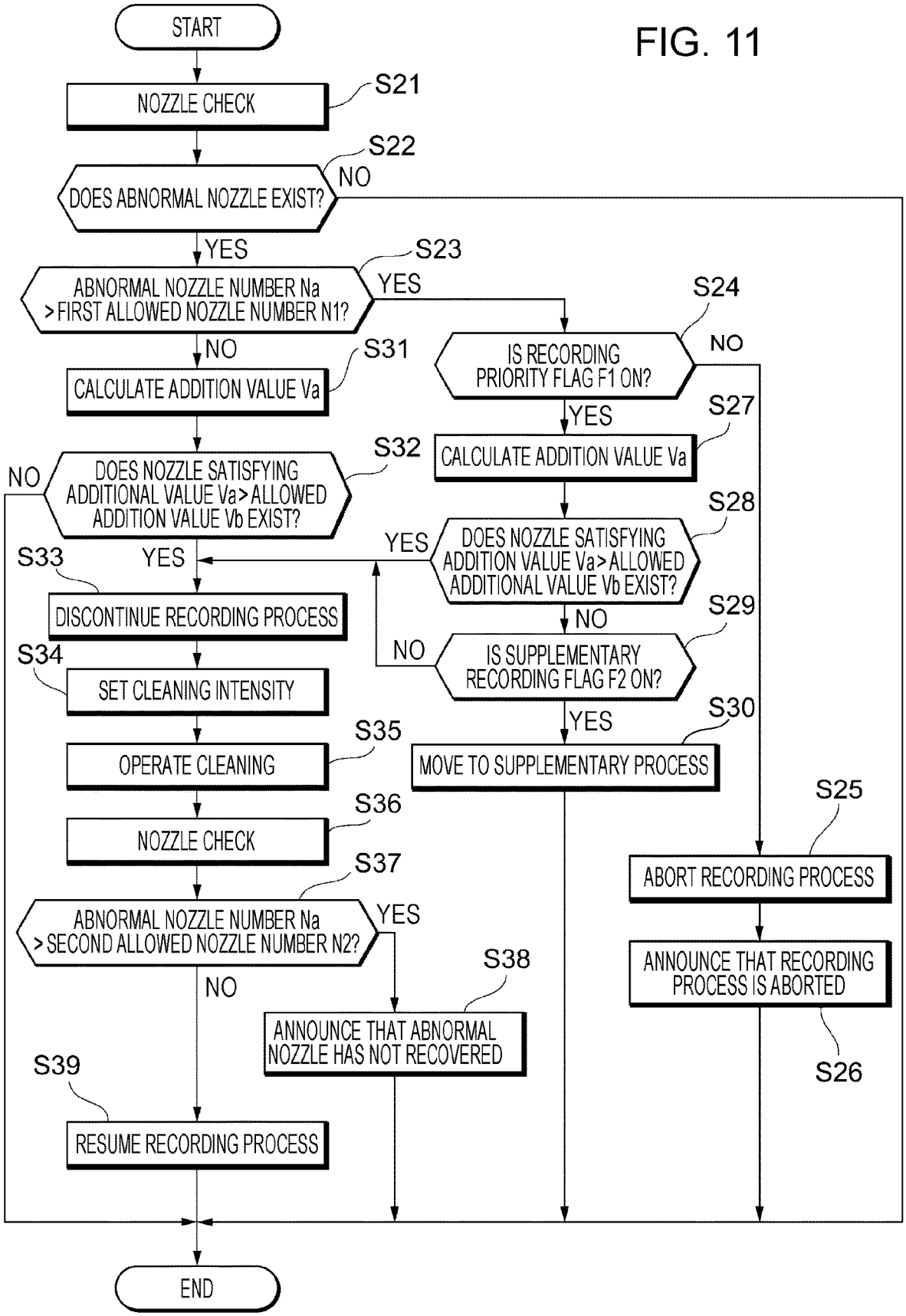
FIG. 11
START
NOZZLE CHECK
S21
DOES ABNORMAL NOZZLE EXIST?
S22
NO
YES
ABNORMAL NOZZLE NUMBER Na > FIRST ALLOWED NOZZLE NUMBER N1?
S23
YES
NO
CALCULATE ADDITION VALUE Va
S31
DOES NOZZLE SATISFYING ADDITIONAL VALUE Va > ALLOWED ADDITION VALUE Vb EXIST?
S32
NO
YES
S33
DISCONTINUE RECORDING PROCESS
S34
SET CLEANING INTENSITY
OPERATE CLEANING
S35
NOZZLE CHECK
S36
ABNORMAL NOZZLE NUMBER Na > SECOND ALLOWED NOZZLE NUMBER N2?
S37
YES
NO
ANNOUNCE THAT ABNORMAL NOZZLE HAS NOT RECOVERED
S38
S39
RESUME RECORDING PROCESS
IS RECORDING PRIORITY FLAG F1 ON?
S24
NO
YES
CALCULATE ADDITION VALUE Va
S27
DOES NOZZLE SATISFYING ADDITION VALUE Va > ALLOWED ADDITIONAL VALUE Vb EXIST?
S28
YES
NO
IS SUPPLEMENTARY RECORDING FLAG F2 ON?
S29
NO
YES
MOVE TO SUPPLEMENTARY PROCESS
S30
ABORT RECORDING PROCESS
S25
ANNOUNCE THAT RECORDING PROCESS IS ABORTED
S26
END

LIQUID EJECTING APPARATUS AND MAINTENANCE METHOD THEREOF

BACKGROUND

1. Technical Field

The present invention relates to a liquid ejecting apparatus and a maintenance method thereof.

2. Related Art

In the related art, a liquid ejecting apparatus that ejects a liquid such as ink onto various printing media and performs printing has been proposed and put to practical use. For example, at present, a liquid ejecting apparatus 1 is proposed that performs printing on the print medium by moving a placement portion 5 on which the print medium (T-shirt) is placed by a driving mechanism 6 in a front/rear direction of a housing portion 2 and ejecting ink toward the print medium from a head portion 110 that reciprocates in a right/left direction in a state where the print medium is in a print area 130 (refer to JP-A-2016-153197).

In such a liquid ejecting apparatus 1 of the related art, a flushing unit 50 is provided. The flushing unit 50 is disposed at an end portion of a no-print area 140 close to the print area 130 and functions to receive ink ejected from the head portion 110. It is said that flushing as a maintenance operation can be performed by the flushing unit 50.

When adopting a configuration in which the placement portion 5 is moved in the front/rear direction of the housing portion 2 as in the liquid ejecting apparatus 1 described in JP-A-2016-153197, it is necessary to provide a gap between the placement portion 5 and the housing portion 2 (that is, to form an opening in a moving area of the head portion 110). When such a configuration is adopted and the flushing unit 50 is disposed at a position close to the print area 130, there is a high possibility that the placement portion 5 and the print medium in the print area 130 are contaminated by the mist of the flushing.

SUMMARY

According to an aspect of the invention, there is provided a liquid ejecting apparatus including a liquid ejecting portion having a liquid ejecting head having a nozzle surface on which a nozzle capable of ejecting a liquid is formed and configured to move the liquid ejecting head in a scanning direction; a placement portion configured to move in a transport direction that intersects with the scanning direction in a state where a medium is placed; a liquid receiving portion configured to receive the liquid ejected from the nozzle; and a maintenance portion that includes a maintenance cap for capping the nozzle surface and performs a maintenance by discharging the liquid from the nozzle, in which a head moving area in which the liquid ejecting head is movable includes a landing area in which the liquid is ejected from the nozzle and landed onto the medium that is placed in the placement portion, a receiving area in which the liquid receiving portion is provided, and a maintenance area in which the maintenance cap is provided, and the receiving area is disposed at a position farther from the landing area than from the maintenance area in the scanning direction.

According to another aspect of the invention, there is provided a maintenance method of a liquid ejecting apparatus, the apparatus including, a liquid ejecting portion provided with a liquid ejecting head that includes a nozzle surface on which a nozzle capable of ejecting a liquid is formed and configured to move the liquid ejecting head in a scanning direction, a placement portion configured to move in a transport direction that intersects with the scanning direction in a state where a medium is placed, a liquid receiving portion configured to receive the liquid ejected from the nozzle, and a maintenance portion that includes a maintenance cap for capping the nozzle surface and performs maintenance by discharging the liquid from the nozzle, in which a head moving area in which the liquid ejecting head is movable includes a landing area in which the liquid is ejected from the nozzle and landed onto the medium placed in the placement portion, a receiving area in which the liquid receiving portion is provided, and a maintenance area in which the maintenance cap is provided, and the receiving area is disposed at a position farther from the landing area than from the maintenance area in the scanning direction, the method including: moving the liquid ejecting head to the receiving area and ejecting the liquid from the nozzle to the liquid receiving portion in a state where the placement portion is in the landing area.

According to still another aspect of the invention, there is provided a maintenance method of a liquid ejecting apparatus, the apparatus including a liquid ejecting portion provided with a liquid ejecting head that has a nozzle surface on which a nozzle capable of ejecting a liquid is formed and configured to move the liquid ejecting head in a scanning direction, a placement portion configured to move in a transport direction that intersects with the scanning direction in a state where a medium is placed, and a maintenance portion that performs a maintenance of the liquid ejecting head, in which a head moving area in which the liquid ejecting head is movable includes a landing area in which a printing process of ejecting the liquid from the nozzle and landing the liquid onto the medium placed in the placement portion is executed and a maintenance area in which the maintenance portion is provided, the method including: performing the maintenance by the maintenance portion prior to the execution of the printing process in a state where the placement portion is at a position from the landing area.

BRIEF DESCRIPTION OF THE DRAWINGS

The invention will be described with reference to the accompanying drawings, wherein like numbers reference like elements.

FIG. 11 is a flowchart showing a flow of a recording process executed by a controller of the liquid ejecting apparatus according to the embodiment of the invention.

DESCRIPTION OF EXEMPLARY EMBODIMENTS

Hereinafter, an embodiment of the liquid ejecting apparatus will be described with reference to the figures. The liquid ejecting apparatus, for example, is a printer that performs recording (printing) by ejecting an ink which is an example of a liquid onto a medium such as a paper.

Figure 1:
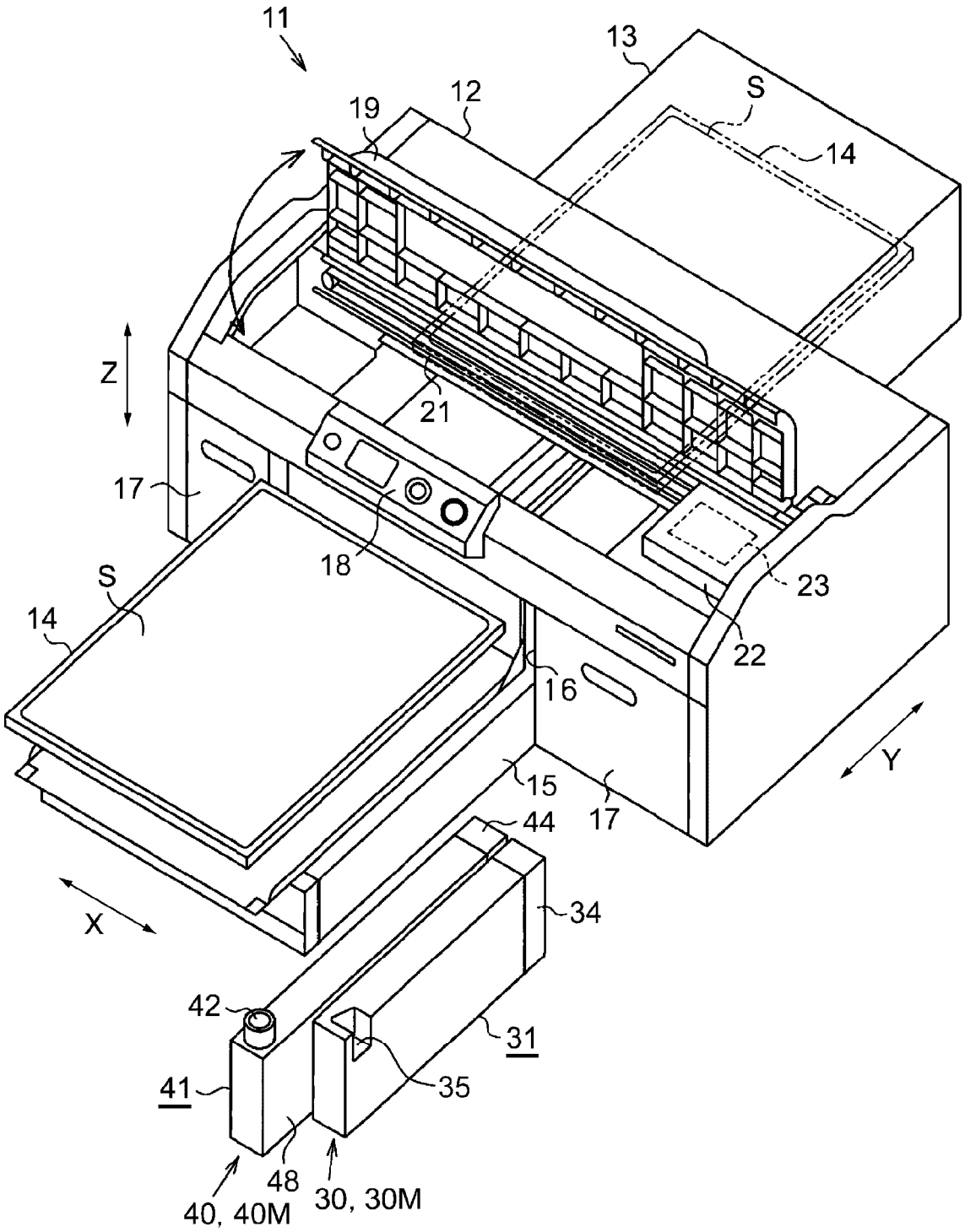
FIG. 1 is a perspective view of a liquid ejecting apparatus, a liquid accommodation body, and an adapter according to an embodiment of the invention.

As shown in FIG. 1, the liquid ejecting apparatus 11 of the embodiment includes an approximately rectangular box-shaped housing portion 12, an accommodation portion 13 that projects from the housing portion 12, a placement portion 14 that is capable of moving with a medium S placed therein, and a transport portion 15 for moving the placement portion 14. The medium S may not be limited to a sheet of paper, but may be a plastic film, a plate material, a hard panel or a corrugated ball, or may be a fabric or a garment such as a T-shirt.

In the embodiment, a direction in which the accommodation portion 13 protrudes from the housing portion 12 is referred to as a rear, and a direction in which the transport portion 15 protrudes from the housing portion 12 is referred to as a front. Then, a direction in which the transport portion 15 moves the placement portion 14 in the front/rear direction in which the housing portion 12 and the accommodation portion 13 are lined is illustrated as a transport direction Y. Also, a direction that intersects (perpendicular in the embodiment) with both the vertical direction Z and the moving direction Y and becomes a longitudinal direction of the housing portion 12 is illustrated as a scanning direction X.

On the front side of the housing portion 12, an opening 16 that permits a placement portion 14 to move in and out of the housing portion 12 as the placement portion 14 moves in the transport direction Y is formed. Also, inside the housing portion 12 and the accommodation portion 13, a space that allows movement of the placement portion 14 in the transport direction Y is formed across the housing portion 12 and the accommodation portion 13.

Figure 2:
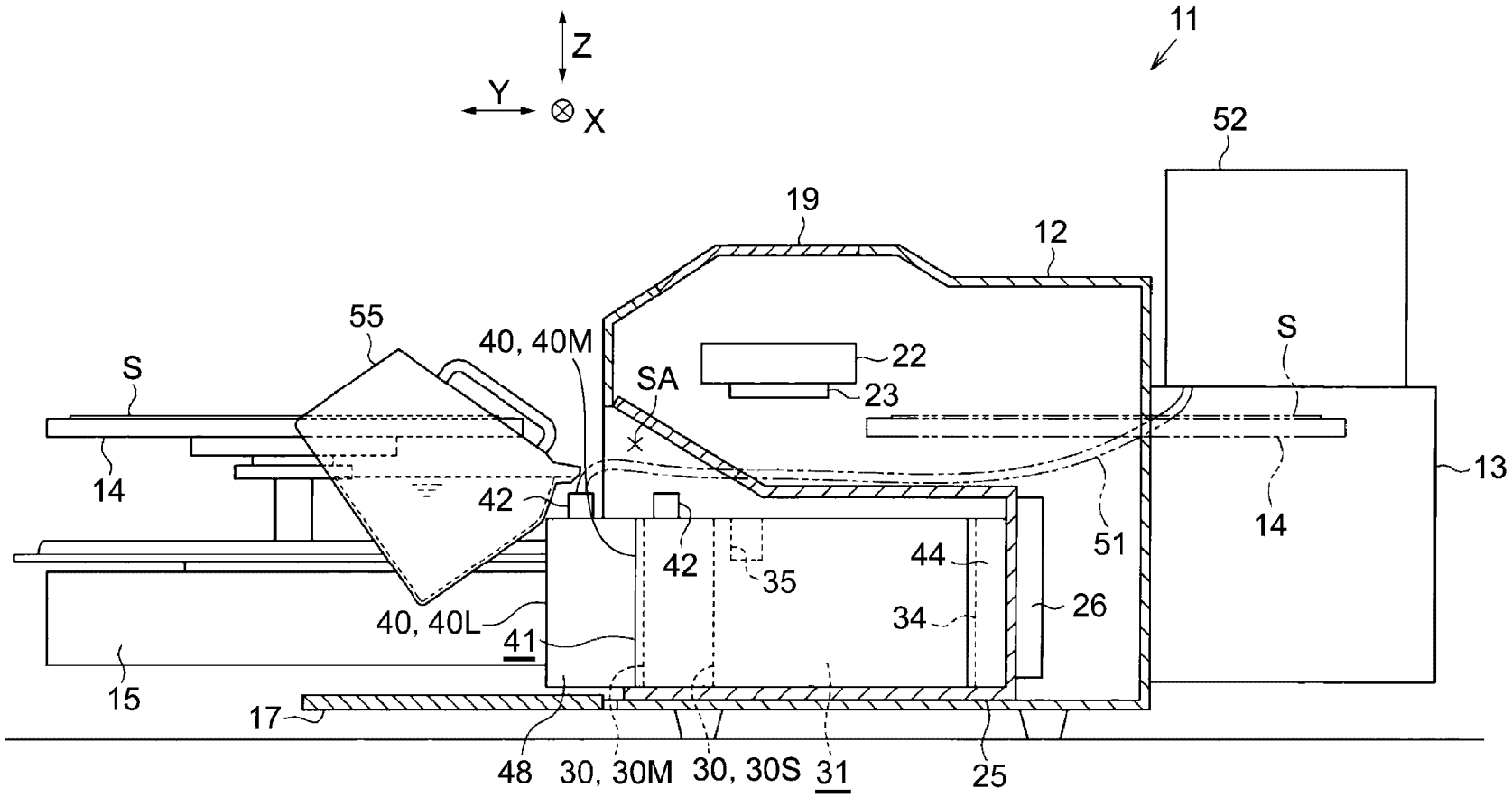
FIG. 2 is a sectional view of the liquid ejecting apparatus with the adapter mounted therein according to the embodiment of the invention.

The placement portion 14 reciprocates in the transport direction Y between a placement position denoted by a solid line in FIGS. 1 and 2 and a printing start position denoted by a dash-dotted line in FIGS. 1 and 2. Further, the placement position is a position at which the medium S is placed on the placement surface of the placement portion 14 outside the housing portion 12, and the printing start position is a position at which the placement portion 14 is temporarily stopped before being moved toward the liquid ejecting portion 23 for printing. When the placement portion 14 is at the printing start position, the rear end side of the placement portion 14 is disposed inside the accommodation portion 13. The placement portion moving area in which the placement portion 14 is movable includes the landing area $A_1$ (FIG. 6) in which the ink is ejected from the nozzle 27 and landed onto the medium S which is placed in the placement portion 14, and the placement position and the printing start position which are already described.

A guide shaft 21 extending in the scanning direction X is provided inside the housing portion 12. The carriage 22 is supported on the guide shaft 21 in a state of being movable in the scanning direction X. Then, the carriage 22 reciprocates in the scanning direction X in accordance with the driving of a driving source (not shown).

Figure 5:
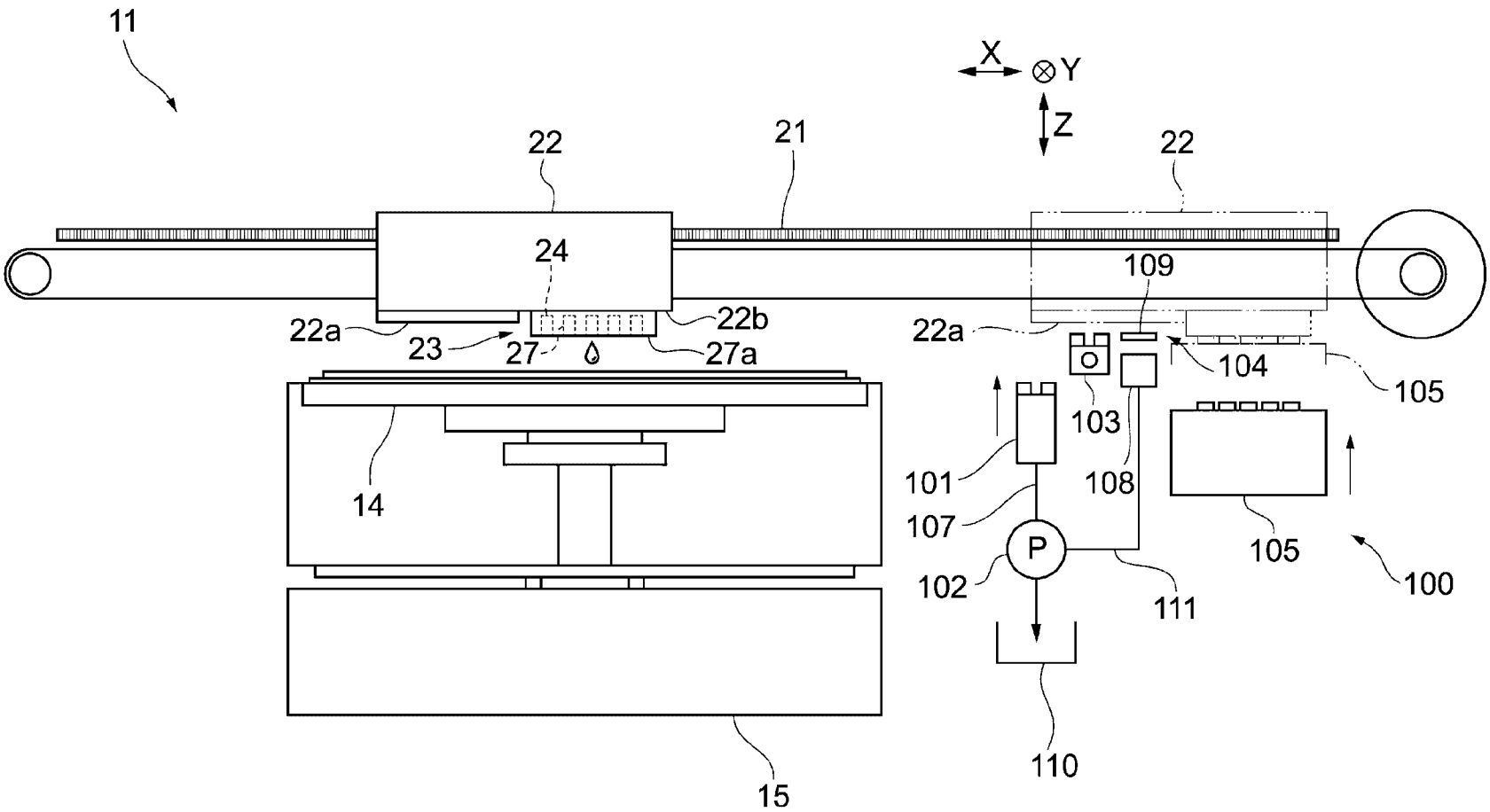
FIG. 5 is a front view showing a disposition of the maintenance system of the liquid ejecting apparatus according to the embodiment of the invention.

A liquid ejecting portion 23 capable of ejecting a liquid such as ink or the like onto the medium S that is placed in the placement portion 14 inside the housing portion 12 is loaded in the carriage 22. Then, the liquid ejecting portion 23 performs printing onto the medium S by ejecting a liquid onto the medium S that moves forward from the printing start position together with the placement portion 14. As shown in FIG. 5, the liquid ejecting portion 23 is provided with a liquid ejecting head 24 that includes a nozzle surface 27*a* on which a nozzle 27 capable of ejecting a liquid by the driving of an actuator is formed. The liquid ejecting portion 23 that includes the liquid ejecting head 24 is enabled to reciprocate in the scanning direction X in accordance with the movement of the carriage 22.

Figure 6:
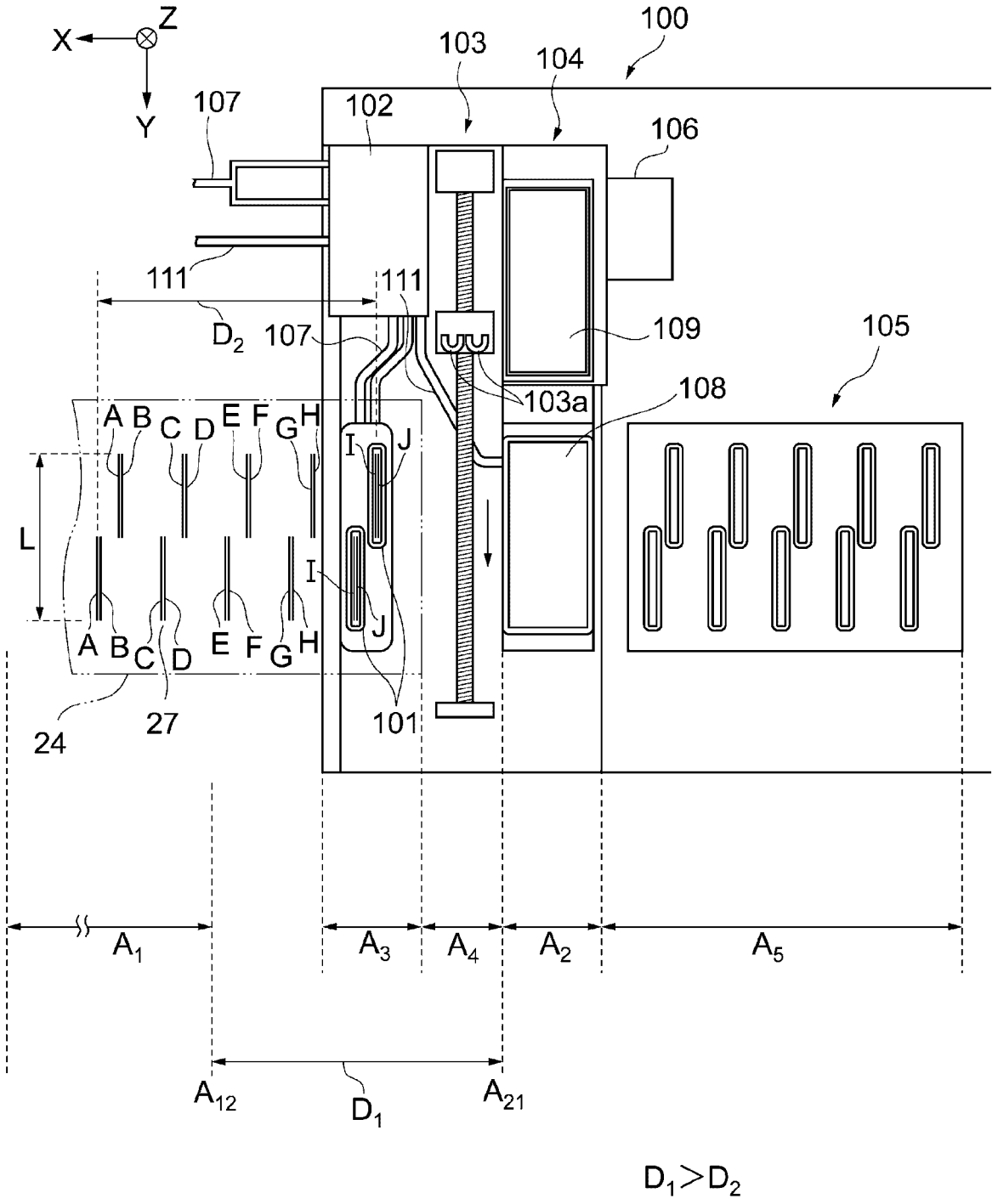
FIG. 6 is a plan view for describing a configuration of the maintenance system of the liquid ejecting apparatus according to the embodiment of the invention.

As shown in FIGS. 5 and 6, in a state where the nozzle surface 27*a* of the nozzle 27 is capped with a moisture retention cap 105 (to be described below), the carriage 22 includes a facing surface 22*a* that faces an opening for receiving a liquid of a liquid receiving portion 108 (to be described later) and a suction cap 101 (to be described below). As shown in FIG. 5, a facing surface 22*a* of the carriage 22 is formed at a position between a bottom surface 22*b* of the carriage and the nozzle surface 27*a* in the vertical direction Z and is separated from an area where a placement portion 14 is movable in a state where the nozzle surface 27*a* of the nozzle 27 is capped with the moisture retention cap 105. Further, it is preferable that the facing surface 22*a* of the carriage 22 be formed at a position closer to the nozzle surface 27*a* than to the bottom surface 22*b* of the carriage 22 (for example, a position at which the distance between the facing surface 22*a* of the carriage 22 and the nozzle surface 27*a* is 0.1 mm to 0.5 mm in the vertical direction), the position being between the bottom surface 22*b* of the carriage 22 and the nozzle surface 27*a*.

An input panel 18 for inputting a command relating to the operation of the liquid ejecting apparatus 11 is attached above the opening 16. Also, an upper cover 19 that covers the opening through which the user accesses the interior of the housing portion 12 when performing maintenance is rotatably provided behind the input panel 18. The upper cover 19 is disposed in the open position shown in FIG. 1 and the closed position shown in FIG. 2 where the user is enabled to access the interior of the housing portion 12 by the rotation around a rotation shaft (not shown) which is provided on the proximal end side.

An opening/closing cover 17 is rotatably attached to the front side of the housing portion 12 at positions which become the two sides of the opening 16 in the scanning direction X. The opening/closing cover 17, rotating so that an upper-end side swings around the rotation shaft (not shown) provided on the lower end side thereof, is disposed in the closed position shown in FIG. 1 and the open position shown in FIG. 2.

As shown in FIG. 2, in the housing portion 12, a mounting portion 25 is accommodated at a position behind the opening/closing cover 17, which is a position different from the position of the placement portion 14 in the scanning direction X which intersect with both the vertical direction and the transport direction Y. In the mounting portion 25, a liquid accommodation body 30 capable of accommodating the liquid to be supplied to the liquid ejecting portion 23 and an adapter 40 are replaceably and attachably/detachably mounted.

The mounting portion 25 is made visually recognizable when the opening/closing cover 17 is disposed in the open position. In the embodiment, the mounting portion 25 is provided on both sides of the housing portion 12 in the scanning direction X. However, the mounting portion 25 may be provided only on one side of the housing portion 12 in the scanning direction X. Also, the number of the liquid accommodation body 30 and the adapter 40 that can be mounted in the mounting portion 25 may be changed randomly.

The mounting portion 25 opens forward. Then, after being inserted through the opening of the mounting portion 25, the liquid accommodation body 30 and the adapter 40 are mounted in the mounting portion 25 by moving backward. Also, the liquid accommodation body 30 and the adapter 40 mounted in the mounting portion 25 are removed from the mounting portion 25 by moving forward from the mounting portion 25.

The mounting portion 25 includes a connection portion 26 at a rear portion which is a back side of the housing portion 12. The liquid accommodation body 30 includes a lead-out portion 34 which is connected to the connection portion 26 when being mounted in the mounting portion 25 and is capable of leading out the accommodated liquid toward the liquid ejecting portion 23. Also, the adapter 40 includes a lead-out portion 44 which is connected to the connection portion 26 when being mounted in the mounting portion 25 and is capable of leading out the liquid toward the liquid ejecting portion 23.

Figure 3:
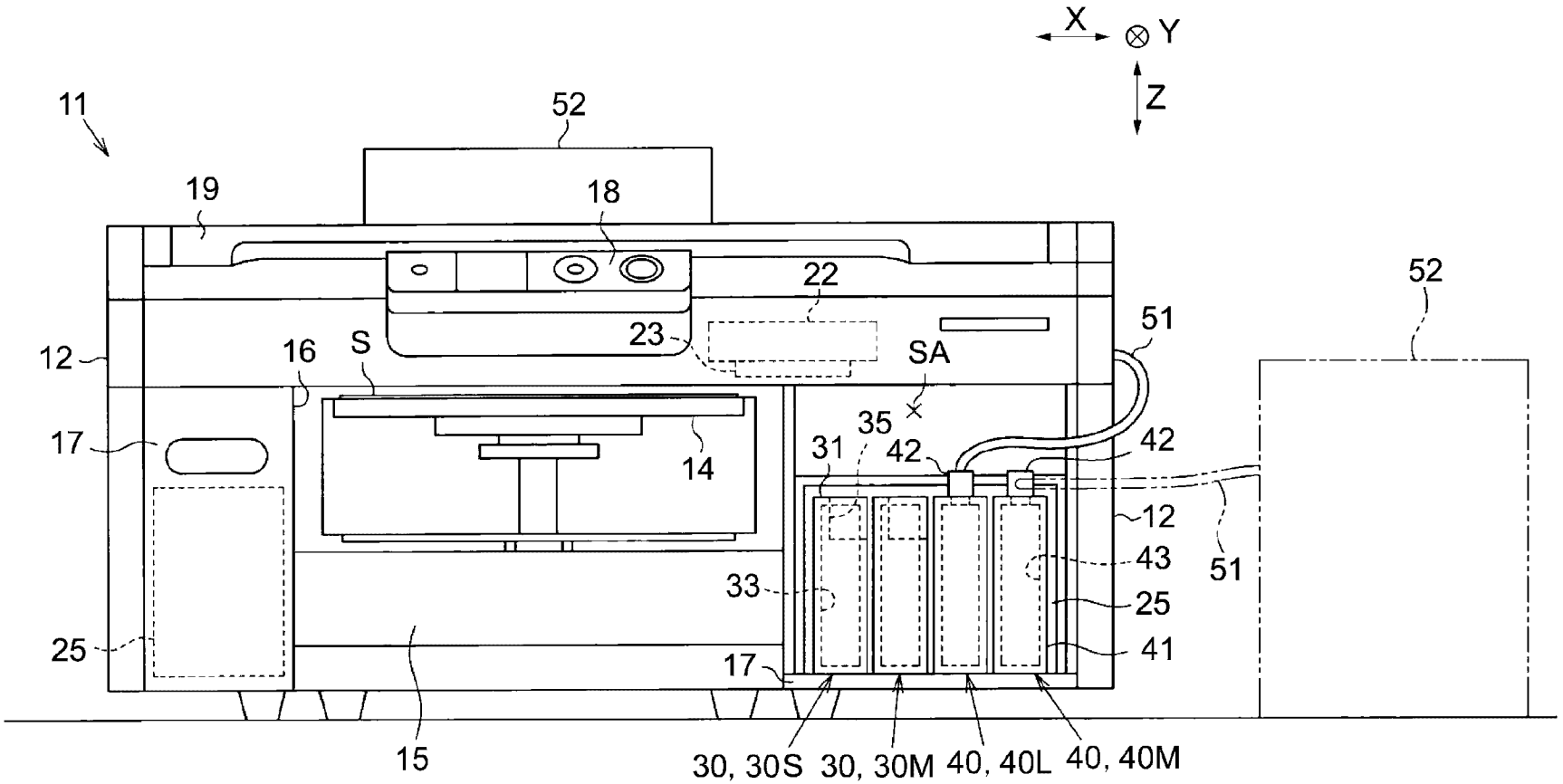
FIG. 3 is a front view of a liquid supply system that includes the adapter according to the embodiment of the invention.

As shown in FIG. 3, the adapter 40 includes an approximately rectangular box-shaped case member 41, a liquid storage portion 43 capable of storing a liquid in the case member 41, and an injection portion 42 capable of injecting a liquid into the liquid storage portion 43. Therefore, the liquid can be replenished by injecting the liquid into the liquid storage portion 43 through the injection portion 42 when the liquid stored in the liquid storage portion 43 of the adapter 40 is reduced.

The injection portion 42 of the adapter 40 is provided to protrude upward in the vertical direction from the upper surface of the case member 41 and also communicates with the liquid storage portion 43. The injection portion 42 of the adapter 40 mounted in the mounting portion 25 is disposed on the side lower than the placement portion 14 in the vertical direction.

The liquid accommodation body 30 includes an approximately rectangular box-shaped case member 31 and a liquid accommodation portion 33 capable of accommodating a liquid in the case member 31, but does not include an injection portion for injecting a liquid into the liquid accommodation portion 33. Accordingly, when the liquid accommodated in the liquid accommodation portion 33 runs out, the liquid accommodation body 30 mounted in the mounting portion 25 is replaced with other liquid accommodation body 30 that accommodates a liquid. Further, in the case member 31 of the liquid accommodation body 30, a finger hooking recess portion 35 is formed on an upper portion on the front side when the liquid accommodation body 30 is mounted in the mounting portion 25, so that a finger can be hooked on when the attachment/detachment operation to/from the mounting portion 25 is performed (also refer to FIG. 1).

As shown in FIGS. 1 and 2, the liquid accommodation body 30 and the adapter 40 having different lengths are replaceably mounted in the mounting portion 25 in the transport direction Y which is the depth direction of the housing portion 12. As shown in FIG. 2, for example, two types of liquid accommodation bodies 30 (30M and 30S) having different lengths in the transport direction Y and two types of adapters 40 (40L and 40M) having different lengths in the transport direction Y are mounted in the mounting portion 25. The length of the liquid accommodation body 30M is nearly the same as the length of the adapter 40M in the transport direction Y. The length of the liquid accommodation body 30S is shorter than the length of the liquid accommodation body 30M in the transport direction Y. The length of the adapter 40L is longer than the length of the adapter 40M in the transport direction Y.

When the lead-out portion 34 is connected to the connection portion 26 of the mounting portion 25, the liquid accommodation body 30 becomes ready for supplying a liquid to the liquid ejecting portion 23. Also, when the lead-out portion 44 is connected to the connection portion 26 of the mounting portion 25, the adapter 40 is ready for supplying to the liquid ejecting portion 23. Therefore, when mounted in the mounting portion 25, the liquid accommodation body 30 and the adapter 40 are inserted into the depth of the mounting portion 25 regardless of the size thereof.

Thus, when the liquid accommodation body 30S, the liquid accommodation body 30M, the adapter 40M, and the adapter 40L are mounted in the mounting portion 25, the front end position of each is out of alignment. Specifically, the front end positions of the liquid accommodation body 30M and the adapter 40M are positioned inside the opening of the mounting portion 25, the front end position of the liquid accommodation body 30S is positioned behind the liquid accommodation body 30M and the adapter 40M (depth side of the mounting portion 25). Also, the front end position of the adapter 40L protrudes forward from the opening of the mounting portion 25.

The adapter 40L includes a protrusion portion 48 that protrudes forward (in the transport direction Y) outside the housing portion 12 when mounted in the mounting portion 25. The injection portion 42 of the adapter 40L is disposed above the protrusion portion 48 to protrude upward in the vertical direction. When the adapter 40L is mounted in the mounting portion 25, the injection portion 42 and the protrusion portion 48 are exposed outside the housing portion 12, so that printing is performed in a state where the opening/closing cover 17 is disposed at an open position.

When the placement portion 14 is at a placement position at which the placement portion 14 is exposed outside the housing portion 12, the protrusion portion 48 and the injection portion 42 of the adapter 40L mounted in the mounting portion 25 are positioned closer to the housing portion 12 than to the placement portion 14 in the transport direction Y and disposed at a position outside the moving area of the placement portion 14.

An operation space SA for performing the attachment/detachment operation of the liquid accommodation body 30 to/from the mounting portion 25 is provided in the upper portion close to the opening of the mounting portion 25 in the housing portion 12. That is, the operation space SA, for example, is a space for inserting a hand of a user when the user puts a finger in a finger hooking recess portion 35 of the liquid accommodation body 30 to remove the liquid accommodation body 30 (30M and 30S) mounted in the mounting portion 25.

When the adapter 40M is mounted in the mounting portion 25, the injection portion 42 of the adapter 40M is disposed in the operation space SA. That is, although the adapter 40M includes the injection portion 42 which protrudes upward from the case member 41, the operation space SA capable of accommodating the injection portion 42 is in the housing portion 12, so that the interference between the injection portion 42 and the mounting portion 25 is avoided.

Figure 4:
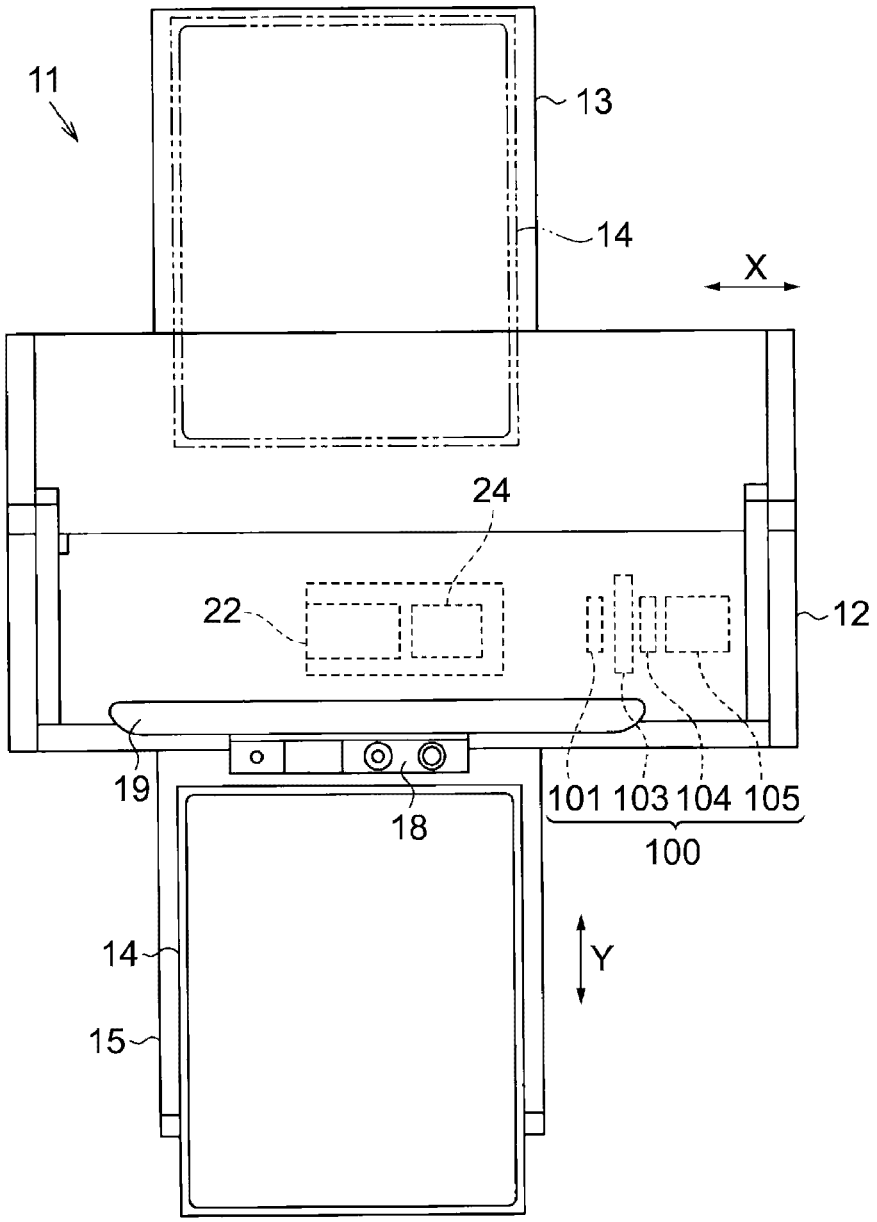
FIG. 4 is a plan view showing a disposition of a maintenance system of the liquid ejecting apparatus according to the embodiment of the invention.

As shown in FIGS. 4 to 6, the liquid ejecting apparatus 11 includes a maintenance system 100 that performs a maintenance operation relating to the liquid ejecting head 24. The maintenance system 100 includes a maintenance unit (maintenance portion) composed of a suction cap 101 and a suction pump 102 for performing a suction cleaning operation as a maintenance operation, a wiping unit (wiping portion) 103 for performing a wiping operation, a flushing unit 104 for receiving a waste liquid generated by flushing, a moisture retention cap 105 for performing a capping, and a driving source 106. A flushing is a maintenance operation in which the liquid ejecting head 24 is forced to eject (discharge) liquid droplets unrelated to the printing from the nozzle 27 to prevent or eliminate a clogging of the nozzle 27. The driving source 106 is, for example, one or a plurality of motors for driving each component of the maintenance system 100.

The suction cap 101 (maintenance cap) and the moisture retention cap 105 are configured to be movable relative to the liquid ejecting head 24 and, when moving relatively in a direction close to the liquid ejecting head 24, perform a capping that forms a closed space where the nozzle 27 opens. Then, the moisture retention cap 105 suppresses drying of the nozzle 27 by performing the capping.

The moisture retention cap 105 slidably supports a holder that holds the moisture retention cap 105 between the capping position at which the holder contacts with the nozzle surface 27*a* and the retreat position which is below the capping position on the landing area $A_1$ side in the scanning direction, and may move between the capping position and the retreat position as the carriage 22 moves in the scanning direction X in a state where the side surface of the carriage 22 is in contact with the protrusion provided on the opposite side of the holder from the landing area $A_1$.

The wiping unit 103 includes two circular-arc wipers 103*a*, and, as the wiper 103*a* moves from the retreat position in the arrow direction of FIG. 6, one wiper 103*a* can wipe two nozzle rows NL (for example, row I and row J) (that is, four nozzle rows are wiped by two wipers 103*a* of the wiping unit 103).

When the liquid ejecting apparatus 11 does not perform printing, the liquid ejecting head 24 moves to a position at which the liquid ejecting head 24 meets the moisture retention cap 105 and stands by in the state of being capped with the moisture retention cap 105. Therefore, the position at which the moisture retention cap 105 exists in the scanning direction X is referred to as a home position of the liquid ejecting head 24.

As the suction pump 102 is driven with the suction cap 101 capping, a negative pressure is generated in the closed space surrounded by the suction cap 101 and the liquid ejecting head 24, and the negative pressure causes the liquid to be sucked and discharged from the nozzle 27, so that the suction cleaning is performed. The liquid discharged from the nozzle 27 by the suction cleaning is accommodated in the waste liquid collection body 110 as a waste liquid.

The maintenance system 100 includes a head suction flow path 107 for collecting the liquid discharged from the liquid ejecting head 24 as a waste liquid by a suction to the nozzle 27. The head suction flow path 107 is made of, for example, an elastically deformable tube that communicates with the suction cap 101, and the suction pump 102 is a tube pump provided in the middle of the head suction flow path 107 which is, for example, a tube.

The liquid ejecting head 24 opens so that a plurality of nozzles 27, lined at predetermined intervals in the transport direction Y, form a nozzle row NL. In this embodiment, two nozzle rows NL of different colors (for example, two rows A and B, two rows C and D, . . . , as shown in FIG. 6) are lined in a set in the scanning direction X. Further, by the arrangement of sets of two nozzle rows NL in the transport direction Y as shown in FIG. 6, the width that can be printed with one scanning becomes L.

For the colors of the nozzle rows NL respectively corresponding to row A, row B, row C, row D, row E, row F, row G, row H, row I and row J, for example, LM (light magenta), C (cyan), LGY (light gray), GY (gray), PBK (photo black), MBK (matte black), DGY (dark gray), Y (yellow), M (magenta) and LC (light cyan) can be adopted. Of the above colors, MBK of the row F may be changed to WH (white). Also, the color arrangement of the ten color specifications may be changed to five color specifications (for example, change row A to C, change rows C and D to BK, change rows E and F to WH, change row G and H to Y, and change rows I and J to M).

When a T-shirt is adopted as the medium S, a white ink is accommodated in the liquid accommodation body 30 and the adapter 40, and the white ink can be ejected from any of rows A through J (for example, row F) to perform a base printing. When a base printing is needed, the base printing is ordered by the operation of the operation portion 71 (FIG. 8) which will be described later, and after the T-shirt on which the base printing is performed is removed from the placement portion 14 and a fixing process is performed, the T-shirt is set in the placement portion 14 again, and the printing instruction is performed by the operation of the operation portion 71.

The maintenance system 100 includes two suction caps 101 located at different positions in the scanning direction X and the transport direction Y so as to perform the suction cleaning for each of the four nozzle rows NL corresponding to two color inks. Also, with the frame-like tip end coming into contact with the liquid ejecting head 24, the two suction caps 101 form a closed space where the nozzle 27 opens.

The flushing unit 104 includes a bottomed box-shaped liquid receiving portion 108 for receiving the liquid ejected from the liquid ejecting head 24 as a waste liquid by a flushing and a lid member 109 for covering the opening of the liquid receiving portion 108. The liquid receiving portion 108 is formed in a size corresponding to the four nozzle rows NL so as to receive the liquid droplets discharged by the flushing performed for each of the four nozzle rows NL corresponding to the two color inks.

The lid member 109, by the driving mechanism (not shown), moves between the closing position at which the opening of the liquid receiving portion 108 is covered and the opening position at which the opening of the liquid receiving portion 108 is exposed. When the flushing is not performed, the lid member 109 moves to the closing position and suppress the drying and the solidification of the waste liquid received in the liquid receiving portion 108.

The maintenance system 100 includes the receiving portion suction flow path 111 for collecting the waste liquid by suction to the liquid receiving portion 108 that receives the liquid ejected by the liquid ejecting head 24 by the flushing as a waste liquid. The receiving portion suction flow path 111 is, for example, an elastically deformable tube which extends from the suction pump 102, which is a tube pump.

When the suction pump 102 is driven, the liquid received in the liquid receiving portion 108 passes through the receiving portion suction flow path 111 to be accommodated in the waste liquid collection body 110. That is, when the suction pump 102 is driven, the suction cleaning is executed, and, at the same time, the waste liquid is collected by suction to the liquid receiving portion 108. When the suction to the liquid receiving portion 108 is performed, it is preferable that the lid member 109 be disposed at the opening position so that the flow of the waste liquid is not obstructed. The waste liquid collection body 110 may be disposed at a position higher than the transport portion 15 for moving the placement portion 14 and the liquid accommodation body 30 and adapter 40 in a state being mounted.

Here, as shown in FIG. 6, the head moving area in which the liquid ejecting head 24 is movable includes the landing area $A_1$ in which the ink (liquid) is ejected from the nozzle 27 and landed onto the medium S placed on the placement surface of the placement portion 14, the receiving area $A_2$ in which the liquid receiving portion 108 of the flushing unit 104 is provided, the maintenance area $A_3$ in which the maintenance cap (suction cap 101) is provided, the wiping area $A_4$ in which the wiping unit 103 is provided, and the standby area $A_5$ in which the moisture retention cap 105 is provided. In the embodiment, the size of the placement surface of the placement portion 14 is the maximum dimension of the landing area $A_1$.

As shown in FIG. 6, the receiving area $A_2$ is disposed at a position farther away from the landing area $A_1$ than from the maintenance area $A_3$ in the scanning direction X. The wiping area $A_4$ is disposed at a position between the maintenance area $A_3$ and the receiving area $A_2$ in the scanning direction X. As a result, the receiving area $A_2$ is disposed at a position farther away from the landing area $A_1$ than from the wiping area $A_4$ in the scanning direction X. The standby area $A_5$ is disposed at a position farther away from the landing area $A_1$ than from the receiving area $A_2$ in the scanning direction X.

Also, the receiving area $A_2$ is disposed such that the distance $D_1$ in the scanning direction between the receiving area side end portion $A_{12}$ of the landing area $A_1$ and the landing area side end portion $A_2$ of the receiving area $A_2$ becomes longer than the distance $D_2$ between the nozzles 27, out of the plurality of nozzles 27 formed on the nozzle surface 27*a*, dispose d at both end positions in the scanning direction ($D_1>D_2$). Therefore, when the leftmost row A out of the nozzle row NL reaches the receiving area side end portion $A_{12}$ of the landing area $A_1$, the rightmost row J out of the nozzle row NL is not in the receiving area $A_2$. That is, when the liquid ejecting head 24 moves from the receiving area $A_2$ to the landing area $A_1$, the rightmost row J has already completed the flushing when the leftmost row A starts printing control. Also, when the liquid ejecting head 24 moves from the landing area $A_1$ to the receiving area $A_2$, the rightmost row J is yet to start flushing when the leftmost row A finished the print control.

Therefore, the controller 70 (FIG. 8) for controlling the liquid ejecting head 24 does not need to perform different controls at the same time for the nozzle row NL of one liquid ejecting head 24. That is, since the landing area $A_1$ and the receiving area $A_2$ are distanced apart from each other by the maintenance area $A_3$ and the wiping area $A_4$ disposed in between, the controller 70 does not need to mix controls to one liquid ejecting head 24 to perform the print control for a part of the nozzle row NL and the flushing control for other nozzle row NL at the same time.

Figure 7:
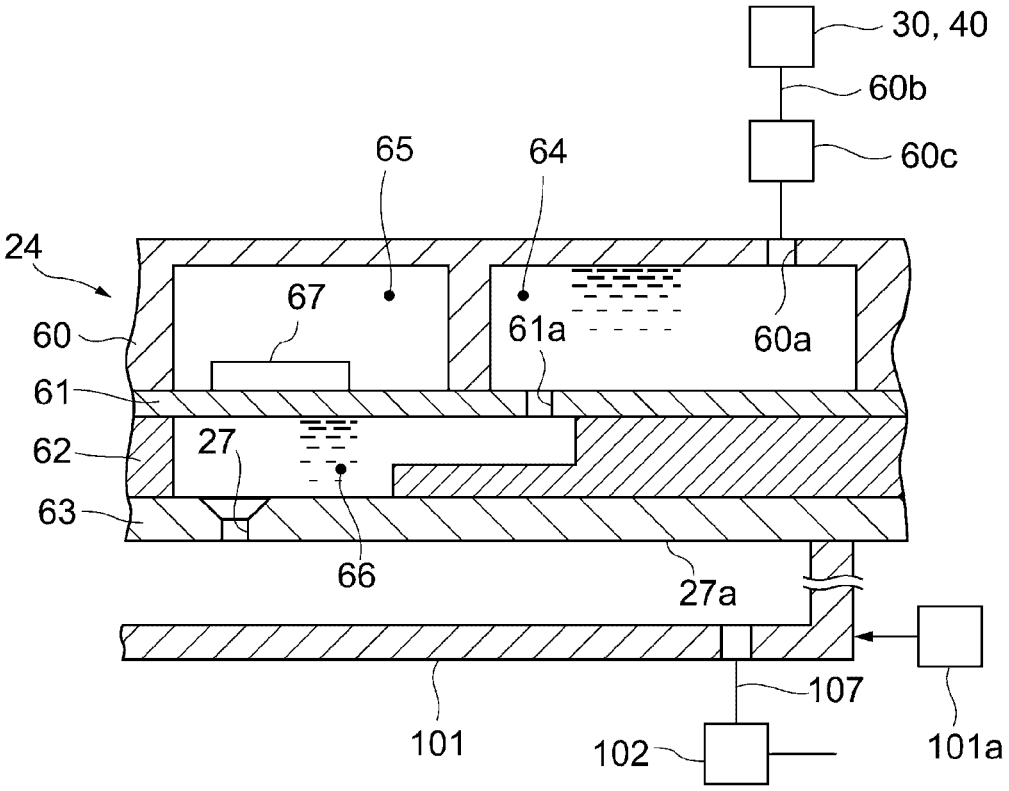
FIG. 7 is a sectional view of a liquid ejecting head during a cleaning operation of the liquid ejecting apparatus according to the embodiment of the invention.

As shown in FIG. 7, the liquid ejecting head 24 of the liquid ejecting apparatus 11 includes a flow path formation member 60, a diaphragm 61, a flow path formation member 62, and a nozzle plate 63. Also, in the liquid ejecting head 24, a common liquid chamber 64 and accommodation chamber 65 are formed by the flow path formation member 60 and the diaphragm 61, and an individual liquid chamber (pressure chamber) 66 is formed by the diaphragm 61, the flow path formation member 62 and the nozzle plate 63. Further, in the liquid ejecting head 24, a supply hole 60*a* is formed in the flow path formation member 60, a communication hole 61*a* is formed in the diaphragm 61, and the above-described nozzle 27 is formed in the nozzle plate 63.

The downstream end of the liquid supply flow path 60*b* of which the upstream end is connected with the liquid accommodation body 30 (adapter 40) is connected with the supply hole 60*a*. Therefore, the liquid accommodated in the liquid accommodation body 30 (adapter 40) is supplied to the common liquid chamber 64 through the liquid supply flow path 60*b*. Also, an opening/closing valve 60*c* that switches between an opening valve state allowing the ink flow and a closing valve state blocking the ink flow is provided in the middle of the liquid supply flow path 60*b*.

Also, the common liquid chamber 64 communicates with a plurality of individual liquid chambers 66 through a plurality of communication holes 61*a*. Therefore, the plurality of individual liquid chambers 66 are supplied with the ink from the common liquid chamber 64 through the plurality of communication holes 61*a*. The individual liquid chamber 66 is partitioned from the accommodation chamber 65 by the diaphragm 61. In the accommodation chamber 65, an actuator 67 such as a piezoelectric element for vibrating the diaphragm 61 is disposed. The actuator 67 vibrates the diaphragm 61 so as to change the volume of the individual liquid chamber 66 by extending or contracting the diaphragm 61 based on the input driving signal.

When the volume of the individual liquid chamber 66 is increased by the driving of the actuator 67 in the liquid ejecting head 24, the ink is supplied from the common liquid chamber 64 to the individual liquid chamber 66. Also, when the volume of the individual liquid chamber 66 is reduced by the driving of the actuator 67 (if the actuator 67 is a piezoelectric element, the application of voltage to the piezoelectric element is stopped), the ink in the individual liquid chamber 66 is ejected as an ink droplet from the nozzle 27. Thus, the liquid ejecting head 24 ejects the ink droplet from the nozzle 27 onto the medium S and execute the recording process to form a character and an image onto the medium S.

As shown in FIG. 7, the maintenance unit (maintenance portion) of the maintenance system 100 includes the suction cap 101 capable of abutting on the nozzle surface 27*a* of the liquid ejecting head 24, a lifting and lowering mechanism 101*a* for lifting and lowering the suction cap 101, the suction pump 102 for sucking the inside of the suction cap 101, the head suction flow path 107 for connecting the suction cap 101 and the suction pump 102. The lifting and lowering mechanism 101*a* can be constituted of, for example, a motor and a mechanism for converting the rotational motion of the motor into a linear motion. The maintenance unit executes a cleaning operation as an example of the maintenance operation in order to recover the nozzle (hereinafter, referred to as "abnormal nozzle") that cannot eject the ink normally due to the factors such as thickening of the ink or mixing of air bubbles from the ejection abnormality.

In the cleaning operation in the maintenance unit, the suction cap 101 is lifted by the lifting and lowering mechanism 101*a* so as to form a closed space facing the opening of the nozzle 27 by the suction cap 101 abutting on the nozzle surface 27*a* and the nozzle surface 27*a*. Subsequently, the suction pump 102 sucks the inside of the closed space, so that the ink inside the liquid ejecting head 24 is forced out into the closed space through the nozzle 27. In this way, air bubbles are discharged together with the ink from the abnormal nozzle and the thickened ink is discharged, so that the ejection normality of the abnormal nozzle is restored.

In the following description, out of the nozzles 27 of the liquid ejecting head 24, the nozzle 27 in which the ejection abnormality of ink has not occurred will be also referred to as "normal nozzle". That is, it can be said that the abnormal nozzle is the nozzle 27 in which the ejection abnormality of ink has occurred and is the nozzle 27 that is not a normal nozzle.

Next, an electric configuration of the liquid ejecting apparatus 11 will be described with reference to FIG. 8.

Figure 8:
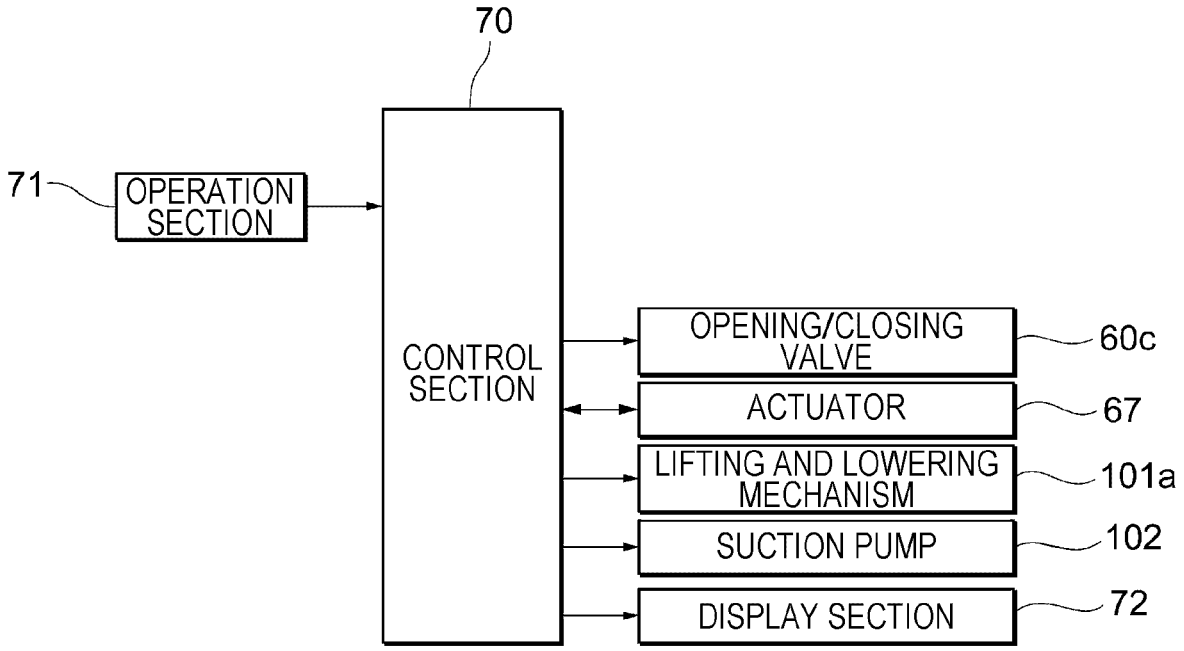
FIG. 8 is a block diagram showing an electrical configuration of the liquid ejecting apparatus according to the embodiment of the invention.

As shown in FIG. 8, the liquid ejecting apparatus 11 includes the controller 70 for controlling various operations in the liquid ejecting apparatus 11. Also, the liquid ejecting apparatus 11 includes the operation portion 71 operated by a user when the user changes various settings relating to the liquid ejecting apparatus 11 or instructs the liquid ejecting apparatus 11 to record (print) and a display portion 72 for displaying various information on the liquid ejecting apparatus 11. The operation portion 71 may be a physical key disposed on the outer surface of the liquid ejecting apparatus 11 and can adopt, for example, various switches, touch panels, or the like provided on the input panel 18. As the display portion 72, a liquid crystal display or the like disposed on the outer surface (for example, the input panel 18) of the liquid ejecting apparatus 11 can be adopted.

The actuator 67 and the operation portion 71 are connected to an interface on the input side of the controller 70, and the opening/closing valve 60*c*, the actuator 67, the lifting and lowering mechanism 101*a*, the suction pump 102 and the display portion 72 are connected to the interface on the output side of the controller 70.

Then, the controller 70 causes the recording process (printing process) to be executed based on the recording job by controlling the driving of the configuration relating to the ejection of the ink and causes the cleaning operation to be executed by controlling the driving of the maintenance unit. When the recording process is executed, the controller 70 causes the operation for ejecting the ink from the liquid ejecting head 24 toward the medium S while moving the carriage 22 in the scanning direction X and the operation for transporting the medium S in the transport direction Y to be performed alternately.

Also, the controller 70 causes the execution of a plurality of cleaning operations in which the amount of ink discharged from the nozzle 27 of the liquid ejecting head 24 is different to be executed by changing the driving mode or the like of the suction pump 102. Specifically, in the cleaning operation, the controller 70 causes the "weak cleaning operation" in which the amount of ink discharged from the nozzle 27 becomes small to be executed by driving the suction pump 102 relatively weakly (when the suction pump 102 is a tube pump, the rotation speed of the rotor is made to slow down or the number of rotation is reduced). Also, in the cleaning operation, the controller 70 causes the "medium cleaning operation" in which the amount of ink discharged from the nozzle 27 becomes moderate to be executed by driving the suction pump 102 relatively strongly (when the suction pump 102 is a tube pump, the rotation speed of the rotor is made faster than the "weak cleaning operation" or the number of rotation is increased). Also, in the cleaning operation, the controller 70 causes the "strong cleaning operation" in which the amount of ink discharged from the nozzle 27 becomes large to be executed by switching the opening/closing valve 60*c* to the opening valve state after the negative pressure inside the closed space is accumulated by switching the opening/closing valve 60*c* to a closing valve state with the suction pump 102 being driven. The cleaning operation with a larger amount of ink discharged from the nozzle 27 increases the performance of recovering the nozzle 27 from the ejection abnormality.

Also, in a state where the placement portion 14 is at a position away from the landing area $A_1$ (for example, placement position shown in FIGS. 1 and 2), the controller 70 causes the maintenance unit to execute the cleaning operation prior to executing the recording process. Also, as will be described in detail later, the controller 70 can also cause the cleaning operation to be performed during the execution of the recording process.

Also, the controller 70 inspects the ejection abnormality in the nozzle 27 based on the driving mode of the actuator 67. Such an inspection is performed in a state where the nozzle 27 (nozzle row NL) to be inspected faces the liquid receiving portion 108. In the following description, checking for the ejection abnormality of the nozzle 27 will be also referred to as "nozzle check". In particular, the controller 70 performs the detection of the ejection abnormality after the medium S is placed in the placement portion 14. In the embodiment, when an input operation for completing the medium placement is performed through the operation portion 71 by a user, the controller 70 determines that the medium S is placed in the placement portion 14, so that the detection of the ejection abnormality is performed.

When the nozzle check is performed, the controller 70 outputs a driving signal for the nozzle check to the actuator 67. Then, after being displaced in accordance with the driving signal, the diaphragm 61 constituting a part of the wall portion of the individual liquid chamber 66 vibrates (residual vibration) in accordance with the state of ink in the individual liquid chamber 66. Thereafter, the controller 70 acquires the electric signal output from the actuator 67 as residual vibration information in accordance with the residual vibration of the diaphragm 61.

The driving signal for the nozzle check may be a driving signal for changing the volume of individual liquid chamber 66. For example, the driving signal may be a driving signal that vibrates the diaphragm 61 to an extent that the ink is ejected from the nozzle 27, or may be a driving signal that vibrates the diaphragm 61 to an extent that the ink is not ejected from the nozzle 27.

Figure 9:
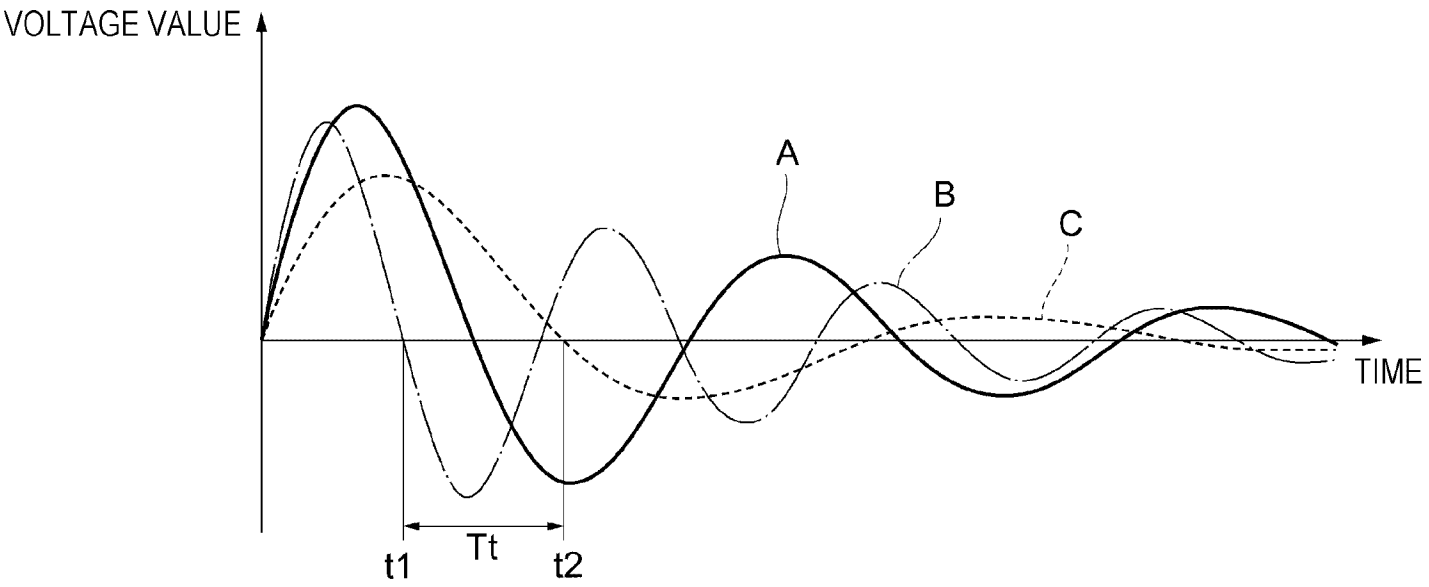
FIG. 9 is a graph showing a signal based on a residual vibration of a diaphragm of the liquid ejecting head.

FIG. 9 shows an example of the residual vibration information output by the actuator 67 to the controller 70. In the graph shown in FIG. 9, the horizontal axis represents time and the vertical axis represents the voltage value of the electric signal output from the actuator 67. As shown in FIG. 9, it is assumed that a reference signal A denoted by a solid line is obtained in a state where the ink can be normally ejected from the nozzle 27. For the reference signal A, for example, when the air bubbles are generated in the ink in the individual liquid chamber 66 to cause an ejection abnormality, the cycle of the signal shortens as in the first ejection failure signal B denoted by a dash-dotted line. On the other hand, for example, when the ink in the individual liquid chamber 66 thickens to cause an ejection abnormality, the cycle of the signal is lengthened as shown in the second ejection failure signal C denoted by a broken line.

Here, in the embodiment, the controller 70 sets the period from the time t1 of the half cycle of the first ejection failure signal B to the time t2 of the half cycle of the second ejection failure signal C as the threshold time Tt ($t1<Tt<t2$) for determining whether or not the ejection state of the ink from the nozzle 27 is defective. That is, if the time of the half cycle of the obtained electric signal is within the range of the threshold time Tt (longer than t1 and shorter than t2), the controller 70 determines that an ejection abnormality has not occurred in the nozzle 27. On the other hand, if the time of the half cycle of the obtained electric signal is outside the range of the threshold time Tt (equal to or shorter than t1 or equal to or longer than t2), the controller 70 determines that an ejection abnormality has occurred in the nozzle 27. Since the threshold time Tt varies depending on the size and the shape of the individual liquid chamber 66 and the type of ink, it is preferable that an appropriate value be set for each liquid ejecting apparatus 11.

Thus, in the embodiment, the actuator 67 has a function of ejecting the ink from the nozzle 27 and has a function of detecting the ejection abnormality in the nozzle 27. In this respect, the actuator 67 is equivalent to an example of the "ejection abnormality detection portion".

Also, when the nozzle abnormality occurs, the controller 70 makes it possible to execute a supplementary process in which the recording process is executed by supplementing the ink to be ejected from the abnormal nozzle with the ink ejected from the normal nozzle. Here, the supplementing method of the supplementary process is as follows.

When the unit transport amount in the case of executing the recording process is set be insufficient for the length of the nozzle row NL in the transport direction Y (for example, half), it becomes possible that the ink is ejected from other nozzle 27 onto the same area on the medium S. In other words, it is possible that the ink is ejected from other nozzle 27 on a different path onto the same area on the medium S. Therefore, as a first supplementing method, there is a method of ejecting dots to be ejected from the abnormal nozzle from other nozzle 27 on other path when a nozzle abnormality occurs.

Also, as a second supplementing method, there is a method of allotting the image data to be recorded with an abnormal nozzle to other adjacent nozzles 27 (normal nozzles) in the upstream/downstream transport directions Y of the abnormal nozzle in accordance with a predetermined algorithm. According to the method, the image that is not recorded due to non-ejection of the ink from an abnormal nozzle is recorded by using other nozzles 27.

Also, as a third supplementing method, there is a method of increasing the density value of the image data for other adjacent nozzles 27 in the upstream/downstream transport directions Y of an abnormal nozzle. According to the method, the density of the image formed by the adjacent normal nozzles in the upstream/downstream transport directions Y of the abnormal nozzle is increased, and the ink is spread to a larger extent than usual, so that the image loss is supplemented.

In the present embodiment, the controller 70 regularly performs a nozzle check during the execution of the recording process. Then, even when an abnormal nozzle is detected in the nozzle check executed during the execution of the recording process, the controller 70 continues the recording process if the number of abnormal nozzles (also referred to as "abnormal nozzle number Na" hereinafter) is equal to or less than the first allowed nozzle number N1 (allowed nozzle number). On the other hand, when the abnormal nozzle number Na is larger than the first allowed nozzle number N1, the controller 70 discontinues the recording process and causes the cleaning operation to be executed in principle. The first allowed nozzle number N1 can be set within a range of "two" or more and less than the number of nozzles of the liquid ejecting head 24.

When an abnormal nozzle in which an ejection abnormality has occurred is left unattended, the ejection abnormality deteriorates by a continued drying or the like in the abnormal nozzle, so that the recovery of the abnormal nozzle from the ejection abnormality becomes difficult sometimes even if the cleaning operation is executed. Therefore, even if the abnormal nozzle number Na is equal to or smaller than the first allowed nozzle number N1, the controller 70 causes the cleaning operation to be executed, if there is a nozzle 27 in which the addition value Va to be added in accordance with the elapsed time in a state where the ejection abnormality has occurred is larger than the allowed addition value Vb.

The addition value Va is calculated for each abnormal nozzle such that the value increases as the elapsed time from the occurrence of the ejection abnormality gets longer. Therefore, when there are a plurality of nozzles having different ejection abnormality timings, the addition value Va of different values is calculated for each abnormal nozzle. Further, the controller 70 stores the information that identifies the nozzle 27 (abnormal nozzle) in which the ejection abnormality has occurred and the information on the timing when the ejection abnormality occurred in the nozzle 27.

Also, when the ambient temperature of the liquid ejecting head 24 is high, the drying in the abnormal nozzle is likely to proceed more easily than when the ambient temperature is low, and the ejection abnormality deteriorates easily. Therefore, the recovery of the abnormal nozzle from the ejection abnormality in the execution of the cleaning operation becomes more difficult within a short period of time when the ambient temperature of the liquid ejecting head 24 is high than when the ambient temperature is low. Then, the controller 70 calculates the addition value Va such that the value becomes larger when the ambient temperature of the liquid ejecting head 24 is high than when the ambient temperature is low.

Thus, according to the embodiment, by setting the allowed addition value Vb at an appropriate level and setting the degree of influence of the ambient temperature of the liquid ejecting head 24 in calculating the addition value Va based on an advance experiment or the like, the difficulty in the recovery of the abnormal nozzle from the ejection abnormality in accordance with the elapsed time in which the cleaning operation of the abnormal nozzle is not executed is alleviated.

Also, when the cleaning operation is executed because the abnormal nozzle number Na is larger than the first allowed nozzle number N1, the controller 70 performs the nozzle check after the execution of the cleaning operation. When the abnormal nozzle number Na detected in the nozzle check is equal to or less than the second allowed nozzle number N2 which is set within the range of less than the first allowed nozzle number N1, the controller 70 causes the discontinued recording process to be resumed. On the other hand, when the abnormal nozzle number Na is larger than the second allowed nozzle number N2, the controller 70 aborts the recording process without resumption. When the abnormal nozzle number Na fails to decline even when the cleaning operation is executed, that is, when the recovery of the liquid droplet ejection performance of the liquid ejecting head 24 is not expected, the recording process is not resumed.

Also, according to the embodiment, the controller 70 can change the setting of various processing conditions in performing the recording based on the recording job. That is, the controller 70 causes the display portion 72 to display the various processing conditions on a setting screen and receives a change in settings based on input from the user through the operation portion 71. Further, the setting of processing conditions refers to the setting of the first allowed nozzle number N1, the second allowed nozzle number N2, and the processing contents when a nozzle abnormality occurs in the recording process. As a result, the liquid ejecting apparatus 11 according to the embodiment can take an action the user desires the liquid ejecting apparatus 11 to take when a nozzle abnormality occurs.

For example, since the white ink of the nozzle row NL (for example, row F) used in the base printing (usually beta printing) on a T-shirt is inconspicuous even when several nozzles fail to eject, the threshold (allowed nozzle number) for deciding whether or not to perform the maintenance operation can be set to be larger than the nozzle rows NL of other colors. Also, it is possible to turn on/off each color and decide whether or not to inspect the nozzle state, and it is also possible to operate the operation portion 71 to turn off all colors, have a nozzle check pattern be printed on a transparent sheet or the like which is set on the placement surface of the placement table 14 and execute the manual cleaning as deemed necessary if a nozzle is missing. In this respect, in the embodiment, an example of the "setting change portion" is configured to include the operation portion 71 and the display portion 72.

Also, the controller 70 calculates the ink consumption amount from the ink ejection number and the ink amount per ejection based on the print data. At this time, the controller 70 can take into consideration the inspection result of the nozzle ejection abnormality (for example, the amount to be ejected by the missing nozzle out of the ink ejection based on the print data is not actually consumed and, therefore, is counted out).

Also, the controller 70 can execute the discharge maintenance which includes a step of moving the liquid ejecting head 24 to the maintenance area $A_3$ and discharging the liquid from the nozzle 27 with the suction cap 101, a step of moving the liquid ejecting head 24 to the wiping area $A_4$ and wiping the nozzle surface 27*a* with the wiping unit 103, and a step of moving the liquid ejecting head 24 to the receiving area $A_2$ and ejecting the liquid from the nozzle 27 to the liquid receiving portion 108. In this way, the movement of the liquid ejecting head 24 in the scanning direction X can be performed when the discharge maintenance is executed in one direction (direction in which the liquid ejecting head 24 moves from the landing area $A_1$ to the receiving area $A_2$). Also, the controller 70 can also execute the discharge maintenance in a state where the placement portion 14 is at the placement position. In this way, contamination of the placement portion 14 and the medium S in the placement portion 14 caused by the mist and the splashing of the liquid droplets when the liquid is ejected (flushing) toward the liquid receiving portion 108 during the discharge maintenance can be suppressed.

Next, the process executed by the controller 70 when the liquid ejecting apparatus 11 is activated will be described with reference to the flowchart shown in FIG. 10.

Figure 10:
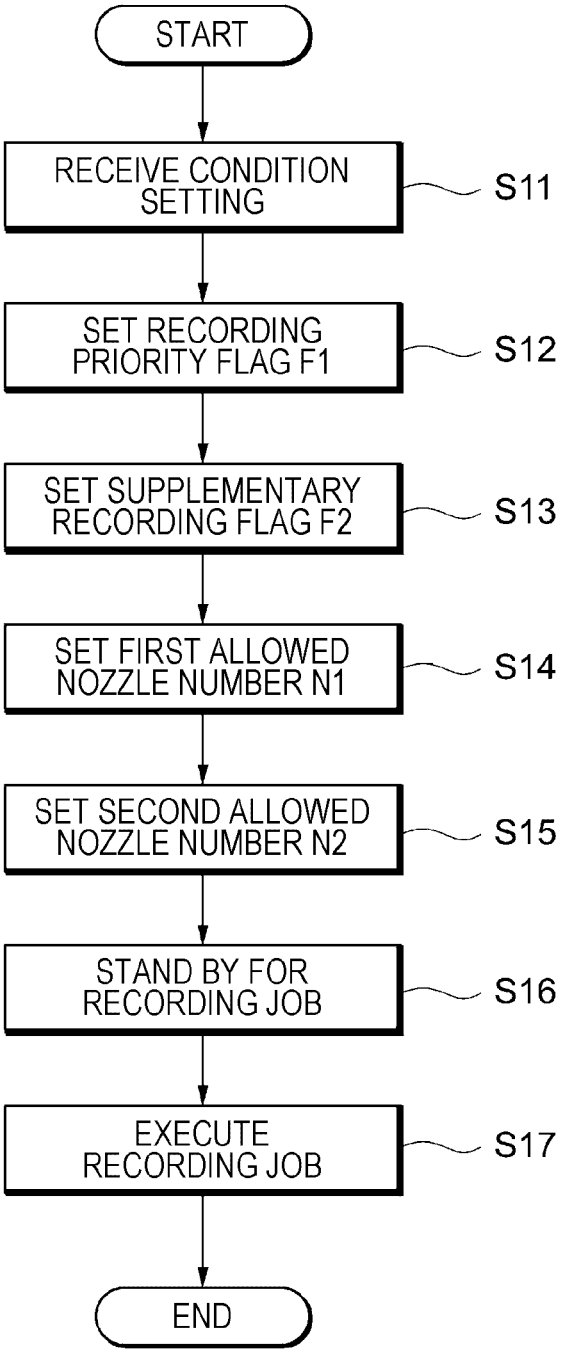
FIG. 10 is a flowchart showing a flow of a process executed by a controller when the liquid ejecting apparatus according to the embodiment of the invention is activated.

As shown in FIG. 10, the controller 70 causes the display portion 72 to display a screen for setting various conditions for the liquid ejecting apparatus 11 to execute the recording process and receives the processing condition set by the user (step S11). In this step S11, the controller 70 receives the information on various flags and variables set in the following steps S12 to S15.

Subsequently, the controller 70 sets the recording priority flag F1 based on the contents received in the step S11 (step S12). The recording priority flag F1 is a flag for selecting the execution of the cleaning operation as a matter of principle or the continuation of the recording process as an exception when the abnormal nozzle number Na is larger than the first allowed nozzle number N1. The recording priority flag F1 is turned on when the priority is given to the recording process and is turned off when the priority is given to the cleaning operation.

Then, the controller 70 sets the supplementary recording flag F2 based on the contents received in the step S11 (step S13). The supplementary recording flag F2 is a flag for selecting the continuation of the recording process by supplementary process or the execution of the cleaning operation as a matter of principle when the nozzle abnormality occurs. The supplementary recording flag F2 is turned on when the continuation of the recording process by the supplementary process is prioritized and is turned off when the cleaning operation is prioritized.

Subsequently, based on the contents received in the step S11, the controller 70 sets the first allowed nozzle number N1 which is the allowed nozzle number during the execution of the recording process (step S14) and sets the second allowed nozzle number N2 which is the allowed nozzle number after the cleaning operation (step S15).

Then, the controller 70 stands by until a recording job is input (step S16) and executes the recording job when the recording job is input (step S17). Thereafter, the controller 70 completes the process. When a new recording job is input during the execution of the recording job, the controller 70 executes the new recording job after executing the prior recording job. In this case, the controller 70 may execute the process of the steps S11 to S15 again.

Next, a flow of the process executed by the controller 70 to decide whether or not the cleaning operation is needed during the execution of the recording job will be described with reference to the flowchart shown in FIG. 11. The process is a process executed for each control cycle set in advance.

As shown in FIG. 11, the controller 70 performs the nozzle check (step S21) and determines whether or not an abnormal nozzle exists (step S22). When no abnormal nozzle exists (step S22: NO), the controller 70 completes the process. On the other hand, when an abnormal nozzle exists (step S22: YES), the controller 70 determines whether or not the abnormal nozzle number Na is larger than the first allowed nozzle number N1 (step S23). When the abnormal nozzle number Na is larger than the first allowed nozzle number N1 (step S23: YES), the controller 70 determines whether or not the recording priority flag F1 is turned on (step S24). When the recording priority flag F1 is turned off (step S24: NO), the controller 70 discontinues the recording process (step S25) and causes the display portion 72 to display the discontinuation of the recording process (step S26). Thereafter, the controller 70 aborts the process.

That is, when a negative determination is rendered in the step S24, the cleaning operation is not executed and the recording process is aborted. The reason for aborting the recording process is that there is a risk that, when the cleaning operation is executed during the execution of the recording process based on one recording job, a boundary (irregularity) is generated between the area where recording is performed before the execution of the cleaning operation and the area where the recording is performed after the execution of the cleaning operation and that the image quality deteriorates. Therefore, it is preferable that the recording priority flag F1 be turned off when the image quality is considered important, and that the recording priority flag F1 be turned on when the recording speed is considered important.

On the other hand, when the recording priority flag F1 is turned on in the previous step S24 (step S24: YES), the controller 70 calculates the addition value Va for each abnormal nozzle in accordance with the elapsed time since the occurrence of nozzle abnormality and the ambient temperature of the liquid ejecting head 24 (step S27). As the elapsed time since the occurrence of the ejection abnormality is "0 (zero)" for an abnormal nozzle in which the occurrence of the ejection abnormality is detected for the first time, the addition value Va is also set at "0 (zero)". Then, when the addition value Va is calculated from the second occurrence onward, the addition value Va is calculated to be larger than "0 (zero)".

Subsequently, the controller 70 determined whether or not there is the nozzle 27 in which the addition value Va is larger than the allowed addition value Vb (step S28). When there exists the nozzle 27 in which the addition value Va is larger than the allowed addition value Vb (step S28: Yes), the controller 70 moves the process to the step S33 to be described later. On the other hand, when there is no nozzle 27 in which the addition value Va is larger than the allowed addition value Vb (step S28: NO), the controller 70 determines whether or not the supplementary recording flag F2 is turned on (step S29). When the supplementary recording flag F2 is turned off (step S29: NO), the controller 70 moves the process to the step S33 to be described later. On the other hand, when the supplementary recording flag F2 is turned on (step S29: YES), the controller 70 moves from the usual recording process to the supplementary process in which the ejection of ink ejected from the abnormal nozzle is supplemented (step S30), and thereafter completes the process.

On the other hand, when the abnormal nozzle number Na is equal to or smaller than the first allowed nozzle number N1 in the previous step S23 (step S23: NO) the controller 70 calculates the addition value Va in the same manner as in the steps S27 and S28 (step S31) and determines whether or not there is the nozzle 27 in which the addition value Va is larger than the allowed addition value Vb (step S32). When there is no nozzle 27 in which the addition value Va is larger than the allowed addition value Vb (step S32: NO), the controller 70 completes the process. That is, this is the case where the abnormal nozzle is not left unattended for a long period of time in a state where the ejection abnormality has occurred, and the recovery of the abnormal nozzle from the ejection abnormality can be judged not to be difficult, even if the cleaning operation of the abnormal nozzle is not executed early.

On the other hand, when there is "one" or more nozzles 27 in which the addition value Va is larger than the allowed addition value Vb (step S32: YES), the process of step S33 is executed in order to execute the cleaning operation of the liquid ejecting head 24. In step S33, the controller 70 causes the recording process to be discontinued for the moment and sets the cleaning intensity in the cleaning operation (step S34). The controller 70 causes the cleaning operation (step S35) to be executed. When the intensity of cleaning operation is set in step S34, the cleaning operation is selected such that the amount of ink discharged from the nozzle 27 increases as the abnormal nozzle number Na detected by the nozzle check in step S34 increases.

When the execution of the cleaning operation ends, the controller 70 performs the nozzle check (step S36). The controller 70 determines whether or not the abnormal nozzle number Na is larger than the second allowed nozzle number N2 (step S37) and announces that the abnormal nozzle has not recovered (step S38) and aborts the process when the abnormal nozzle number Na is larger than the second allowed nozzle number N2 (step S37: YES). That is, in this case, since the abnormal nozzle number Na does not decrease after the cleaning operation and it is considered that the repeated execution of the cleaning operation will not restore the ejection normality, the discontinued recording process is aborted. On the other hand, when the abnormal nozzle number Na is equal to or smaller than the second allowed nozzle number N2 (step S37: NO), the controller 70 resumes the recording process (step S39) that was discontinued in step S33 and completes the process.

In the flowchart shown in FIG. 11, when the abnormal nozzle number Na detected during the execution of the recording process is larger than the first allowed nozzle number N1 (step S23: YES), the recording process can be continued if the recording priority flag F1 is turned on (step S24: YES), on the condition that there is no nozzle 27 in which the addition value Va is larger than the allowed addition value Vb (step S28: NO). On the other hand, when the abnormal nozzle number Na detected during the execution of the recording process is larger than the first allowed nozzle number N1 (step S23: YES), the cording process is aborted (step S25), if the recording priority flag F1 is turned off (step S24: NO). Thus, in the embodiment, it becomes possible to switch the processes when the abnormal nozzle number Na detected during the execution of the recording process is larger than the first allowed nozzle number N1 by the recording priority flag F1 that can be set by the user before the start of the recording process.

Also, when the recording process is continued on the condition that there is no nozzle 27 in which the addition value Va is larger than the allowed addition value Vb, the supplementary process is executed (step S30), if the supplementary recording flag F2 is turned on (step S29: YES). On the other hand, when the recording process is continued on the condition that there is no nozzle 27 in which the addition value Va is larger than the allowed addition value Vb, the recording process is executed after the cleaning operation is executed (steps S35 and S39) if the supplementary recording flag F2 is turned off (step S29: NO). Thus, in the embodiment, the process when the recording process is continued in a state where more abnormal nozzles are detected than the first allowed nozzle number N1 can be switched by the supplementary recording flag F2 that can be set by the user before the start of the recording process.

In the liquid ejecting apparatus 11 according to the embodiment described above, the receiving area $A_2$ is disposed at a position farther away from the landing area $A_1$ than from the maintenance area $A_3$ in the scanning direction X, so that the area in which the mist and the splashing of the liquid droplets are generated when the liquid is ejected (flushing) by the liquid ejecting head 24 toward the liquid receiving portion 108 during the discharge maintenance can be kept away from the landing area $A_1$. Therefore, the contamination of the landing area $A_1$, the placement portion 14 and the medium S in the placement portion 14 by the mist and the splashing generated at the time of flushing can be suppressed.

Also, in the liquid ejecting apparatus 11 according to the embodiment described above, the receiving area $A_2$ is disposed at a position away from the landing area $A_1$ by the wiping area $A_4$, so that the area in which the mist and the splashing of the liquid droplets are generated when the liquid is flushed can be kept farther away from the landing area $A_1$. Therefore, the contamination of the landing area $A_1$, the placement portion 14 and the medium S in the placement portion 14 by the mist and the splashing generated at the time of flushing can be further suppressed.

Also, in the liquid ejecting apparatus 11 according to the embodiment described above, in a state where the nozzle surface 27*a* of the liquid ejecting head 24 is capped by the moisture retention cap 105, the facing surface 22*a* of the carriage 22 that holds the liquid ejecting head 24 can be placed to face the opening for receiving the liquid of the liquid receiving portion 108. Therefore, the mist generated by the flushing to the liquid receiving portion 108 can be prevented from diffusing into a wide range and reaching the landing area A1.

Also, in the liquid ejecting apparatus 11 according to the embodiment described above, in a state where the nozzle surface 27*a* of the liquid ejecting head 24 is capped by the moisture retention cap 105, the facing surface 22*a* of the carriage 22 that holds the liquid ejecting head 24 can be placed to face the suction cap 101 of the maintenance unit. Therefore, the drying of the suction cap 101 can be suppressed.

Also, in the liquid ejecting apparatus 11 according to the embodiment described above, in a state where the nozzle surface 27*a* is capped with the moisture retention cap 105, the facing surface 22*a* of the carriage 22 can be kept away from the area where the placement portion 14 is movable. Therefore, even when the mist generated by the flushing of the liquid receiving portion 108 adheres to the facing surface 22*a* of the carriage 22, the contamination of the placement portion 14 and the medium S in the placement portion 14 by the contact with the facing surface 22*a* of the carriage 22 can be suppressed.

Also, in the liquid ejecting apparatus 11 according to the embodiment described above, since the lid member 109 that moves between the closing position at which the opening through which the liquid receiving portion 108 receives the liquid is covered and the opening position at which the opening is exposed is provided, the thickening of the liquid received in the liquid receiving portion 108 can be suppressed. Also, since the opening of the liquid receiving portion 108 is covered with the lid member 109 after the flushing, the diffusion of the mist generated by the flushing can be suppressed.

Also, according to the embodiment, in the liquid ejecting apparatus 11, the receiving area A2 is disposed such that the distance $D_1$ in the scanning direction X receiving area side end portion $A_{12}$ of the landing area $A_1$ and the landing area side end portion $A_{21}$ of the receiving area $A_2$ becomes longer than the distance $D_2$ between the nozzles disposed at both end positions of the nozzle surface 27*a* of the liquid ejecting head 24 in the scanning direction. Therefore, there is an advantage that it is not necessary to mix controls to one liquid ejecting head 24 to perform the print control for a part of the nozzles 27 and the flushing control for other nozzles 27 at the same time.

In the embodiment described above, an example in which the maintenance operation before the printing process is executed when the placement table 14 is at the placement position is presented. However, it is also possible to execute the maintenance operation before the printing process when the placement table 14 is at the printing start position (the position indicated by the dash-dotted line in FIGS. 1 and 2).

Also in the embodiment described above, an example in which the detection of the ejection abnormality is performed with the determination that the medium S is placed in the placement portion 14 when an input operation for completing the medium placement is performed by a user through the operation portion 71 is presented. However, when a sensor for detecting the placement of the medium S in the placement portion 14 is provided, the detection of the ejection abnormality may be performed when the medium S is detected by the sensor.

Also, in the embodiment described above, an example in which the nozzle state inspection is performed by the actuator 67 of the liquid ejecting head 24 is presented. However, such a function may not be loaded. In this case, it is possible to identify the missing nozzle by the nozzle check pattern print and execute the manual cleaning in the same manner as when the nozzle is inspected with all colors being turned off.

Also, in the embodiment described above, as the arrangement inside the maintenance system 100 is shown in FIG. 6, the maintenance cap (suction caption 101), the wiping unit 103, the liquid receiving portion 108 of the flushing unit 104 and the moisture retention cap 105 are arranged in the order in the scanning direction X, the maintenance cap being closest to, and the moisture retention cap 105 being farthest from, the landing area $A_1$. However, the arrangement may be in the order of the wiping unit 103, the maintenance cap (suction cap 101), the flushing unit 104 of the liquid receiving portion 108 and the moisture retention cap 105 in the scanning direction X, the wiping unit 103 being closest to the landing area $A_1$. In this case, the maintenance area $A_3$ is arranged at a position between the wiping area $A_4$ and the receiving area $A_2$ in the scanning direction X.

Also, in the embodiment described above, an example in which the moisture retention cap 105 is arranged on the right side of the landing area $A_1$ (FIG. 6) is presented, but the moisture retention cap 105 can be arranged on the left side of the landing area $A_1$. In such a case, the landing area $A_1$ is positioned between the moisture retention cap 105 and the maintenance cap 101.

Also, in the embodiment described above, an example in which only one placement portion 14 is adopted is presented, but a plurality of the placement portions 14 can be arranged side by side in the scanning direction X, so that a plurality of the media S can be printed in a single print operation.

The invention is not limited to the above embodiments, and the embodiments to which the appropriate design modifications are added by those skilled in the art are also included within the scope of the invention as long as they have the features of the invention. That is, the elements and the arrangement, the materials, the conditions, the shapes, and the size thereof included in the embodiment are not limited to the examples and can be appropriately modified. Also, the elements included in the embodiment described above can be combined as far as technically possible, and the combination thereof are also included within the scope of the invention as long as they include the features of the invention.

The entire disclosure of Japanese Patent Application No. 2018-008602, filed Jan. 23, 2018 and No. 2018-008601, filed Jan. 23, 2018 are expressly incorporated by reference herein.

What is claimed is:

1. A liquid ejecting apparatus comprising:

a liquid ejecting portion configured to move a liquid ejecting head in a scanning direction, the liquid ejecting head having a nozzle surface on which a nozzle is capable of ejecting a liquid;

a placement portion configured to move in a transport direction that intersects the scanning direction in a state where a medium is placed;

a liquid receiving portion configured to receive the liquid ejected from the nozzle; and a maintenance portion that includes a maintenance cap for capping the nozzle surface and performs a maintenance by discharging the liquid from the nozzle, wherein a head moving area in which the liquid ejecting head is movable includes a landing area in which the liquid is ejected from the nozzle and landed onto the medium that is placed in the placement portion, a receiving area in which the liquid receiving portion is provided, and a maintenance area in which the maintenance cap is provided, and the maintenance area is disposed at a position between the landing area and the receiving area in the scanning direction.

2. The liquid ejecting apparatus according to claim 1, further comprising:

a wiping portion that wipes the nozzle surface, wherein the head moving area further includes a wiping area in which the wiping portion is provided, and the wiping area is disposed at a position between the maintenance area and the receiving area in the scanning direction.

3. The liquid ejecting apparatus according to claim 2, wherein the head moving area includes a standby area in which a moisture retention cap that retains moisture by capping the nozzle surface is provided, and the standby area is disposed at a position farther from the landing area than from the receiving area in the scanning direction.

4. The liquid ejecting apparatus according to claim 3, wherein the liquid ejecting portion includes a carriage that holds the liquid ejecting head, and the carriage includes a facing surface that faces an opening of the liquid receiving portion for receiving the liquid in a state where the nozzle surface is capped with the moisture retention cap.

5. The liquid ejecting apparatus according to claim 4, wherein the carriage includes a facing surface that faces the maintenance cap of the maintenance portion in a state where the nozzle surface is capped with the moisture retention cap.

6. The liquid ejecting apparatus according to claim 4, wherein the facing surface of the carriage is from an area in which the placement portion is movable in a state where the nozzle surface is capped with the moisture retention cap.

7. The liquid ejecting apparatus according to claim 3, further comprising:

a lid member that moves between a closing position at which an opening of the liquid receiving portion for receiving the liquid is covered and an opening position at which the opening is exposed.

8. The liquid ejecting apparatus according to claim 3, wherein the receiving area is disposed such that a distance between an receiving area side end portion of the landing area and a landing area side end portion of the receiving area in the scanning direction is longer than a distance between the nozzles, out of a plurality of the nozzles that are formed on the nozzle surface, that are disposed at both end positions in the scanning direction.

9. The liquid ejecting apparatus according to claim 3, further comprising:

an ejection abnormality detection portion that detects an ejection abnormality in the nozzle, wherein, when the nozzle in which the ejection abnormality is detected is set as an abnormal nozzle and the number of abnormal nozzles is set as an abnormal nozzle number, the controller causes the maintenance portion to perform the maintenance based on the abnormal nozzle number detected by the ejection abnormality detection portion.

10. The liquid ejecting apparatus according to claim 9, further comprising:

a setting change portion configured to set a processing condition that includes an allowed nozzle number that is the allowed abnormal nozzle number prior to the execution of the printing process, wherein the controller causes the maintenance portion to perform the maintenance when the abnormal nozzle number detected by the ejection abnormality detection portion is larger than the allowed nozzle number.

11. The liquid ejecting apparatus according to claim 9, wherein the liquid is ejected from the nozzle by the driving of an actuator, the ejection abnormality detection portion detects the ejection abnormality in the nozzle by detecting a vibration waveform of a pressure chamber that communicates with the nozzle, when the actuator is driven, and the controller causes the ejection abnormality detection portion to detect the ejection abnormality during the execution of the printing process and causes the maintenance portion to perform the maintenance based on the detected abnormal nozzle number.

* * * * *